US005683846A

United States Patent [19]

Ishihara et al.

[11] Patent Number: 5,683,846

[45] Date of Patent: Nov. 4, 1997

[54] ELECTROPHOTOGRAPHIC DEVELOPER HAVING A SPECIFIC VOLTAGE-DEPENDANT INDEX

[75] Inventors: Takahiro Ishihara; Kiyofumi Nakatsu, both of Osaka, Japan

[73] Assignee: Mita Industrial Co., Ltd., Osaka, Japan

[21] Appl. No.: 542,405

[22] Filed: Oct. 12, 1995

[30] Foreign Application Priority Data

Nov. 1, 1994 [JP] Japan ..... 6-269030

[51] Int. Cl.[6] ..... G06G 9/00

[52] U.S. Cl. ..... 430/111; 430/106.6

[58] Field of Search ..... 430/111, 106.6

[56] References Cited

U.S. PATENT DOCUMENTS 5,376,489 12/1994 Yabe et al. ..... 430/111

FOREIGN PATENT DOCUMENTS 361939 4/1990 European Pat. Off. .

449541 10/1991 European Pat. Off. .

61-204646 9/1986 Japan .

62-293525 12/1987 Japan .

1-156764 6/1989 Japan .

4-321073 11/1992 Japan .

*Primary Examiner*—Mark Chapman

*Attorney, Agent, or Firm*—Beveridge, DeGrandi, Weilacher & Young, LLP

[57] ABSTRACT

The present invention provides an electrophotographic developer comprising a magnetic carrier and a toner, wherein a certain voltage-dependent index Y of the developer and a number proportion X (%) of a certain non-charged toner in the total toner have a relation satisfying the following formula (3):

$$Y>3X/400+1 \quad (3).$$

This developer can certainly prevent blur of the image, such as forward flow or backward flow, while maintaining a high image density.

6 Claims, 4 Drawing Sheets

ELECTROPHOTOGRAPHIC DEVELOPER HAVING A SPECIFIC VOLTAGE-DEPENDANT INDEX

BACKGROUND OF THE INVENTION

The present invention relates to a two-component electrophotographic developer comprising a magnetic carrier and a toner, which is used for image forming apparatuses such as electrostatic copying machine, laser beam printer, facsimile.

In the above image forming apparatus, the surface of an uniformly charged photoconductor is firstly exposed to light to form an electrostatic latent image on the surface of the photoconductor. Then, a developer is brought into contact with the surface of this photoconductor using a developing apparatus. Thereby, a toner contained in the developer electrostatically adheres to the electrostatic latent image to visualize the electrostatic latent image to form a toner image. When this toner image is transferred on a paper from the surface of the photoconductor to fix it, an image corresponding to the electrostatic latent image is formed on the surface of the paper.

As the developer, there can be normally used a two-component developer comprising a toner and a magnetic carrier circulating in a developing apparatus in the state where in the toner is adsorbed. The visualization of the electrostatic latent image due to the above two-component developer is normally referred to as a "magnetic brush developing method" and is a method comprising adhering magnetically a two-component developer on the surface of a developing sleeve of a developing apparatus, which is oppositely provided on the surface of the photoconductor, by a magnet built in the developing sleeve to form a magnetic brush, and then bringing this brush into contact with the surface of the photoconductor to electrostatically adhere the toner in the magnetic brush to the electrostatic latent image.

As the two-component developer to be used for the magnetic brush developing method, those which are suitable for performances (particularly, image forming velocity) of the image forming apparatus to be used are preferred. For example, there have been widely used general-purpose developers which are designed so that they can form a high-density image having an image density of not less than 1.35 in various kinds of machines of which image forming velocity is within a range of about 10 to 30 copies/minute (in a side size of JIS A4 paper).

However, the above general-purpose developer had a problem that blur arises around the solid image part of the formed image, particularly front or rear of the image forming direction (forward blur and backward blur are referred to as "forward flow" and "backward flow", respectively) due to a slight difference between systems of image forming apparatuses to be used (e.g. slight difference in surface potential, or position of magnetic poles of the magnet in the developing sleeve).

Blur such as forward flow or backward flow is generated when a part of the toner is scratched off by the magnetic brush from the toner image, which is the solid image part, formed on the surface of the photoconductor, thereby shifting to the position which is outside of the image. It depends upon the type of the magnetic brush developing method whether forward flow or backward flow is generated.

That is, the magnetic brush developing method includes a type of moving the magnetic brush in the same direction as the moving direction of the surface of the photoconductor (forward direction type) and a type of moving in the reverse direction of the moving direction of the surface of the photoconductor (reverse direction type). Among them, in the forward direction type, the magnetic brush is moved faster than the photoconductor and, therefore, the toner is shifted in front of the toner image. As a result, forward flow is liable to be generated in the formed image. On the other hand, in the backward direction type, the toner is shifted in rear of the toner image when the photoconductor and magnetic brush pass each other. As a result, backward flow is liable to be generated in the formed image.

In Japanese Unexamined Patent Publication No. 2-37366, there is disclosed a magnetic carrier wherein a specific resistance value at an electric charge strength of 1000 V/cm is set at a value higher than a conventional one, such as $5\times10^8$ to $2\times10^9$ Ω·cm, in order to prevent the generation of backward flow in the reverse direction type magnetic brush developing method.

Normally, the magnetic carrier and toner show a voltage dependence of the resistance value, that is, the higher the applied voltage, the lower the resistance value is, while the lower the applied voltage, the higher the resistance value is. Therefore, the toner is liable to adhere to the high potential part corresponding to the solid image part of the surface of the photoconductor, and adhere hardly to the part other than the above part. In addition, when the resistance value of the magnetic carrier in the state wherein the applied voltage is high is set at the slightly high value, as described above, the amount of the toner to be adhered to the high potential part corresponding to the solid image part of the surface of the photoconductor is inhibited. Therefore, the amount of the toner to be scratched off by the magnetic brush to shift to the position which is outside of the toner image is decreased, which results in inhibition of blur of the image, such as backward flow.

However, when using the above magnetic carrier to inhibit the amount of the toner to be adhered to the high potential part corresponding to the solid image part, the image density of the solid image part is necessarily decreased. Therefore, it becomes impossible to form the high-density image.

SUMMARY OF THE INVENTION

A main object of the present invention is to provide an electrophotographic developer which can certainly prevent blur of the image, such as forward flow or backward flow, while maintaining a high image density.

The electrophotographic developer to accomplish the above object comprises a magnetic carrier and a toner, wherein a voltage-dependent index Y of the developer, obtained from resistance values $R_{500}$ (Ω·cm) and $R_{2500}$ (Ω·cm), which are measured at electric field strengths of 500 V/cm and 2500 V/cm, respectively, in accordance with the formula (1):

$$Y=\log(R_{500})/\log(R_{2500}) \quad (1)$$

and a number proportion X (%), in the total toner, of a non-charged toner which is within a region of the formula (2):

$$Q/D<0.2 \quad (2)$$

in a charged amount distribution of toner defined by a charged amount Q (femt. C) and a particle size D (μm) of the toner, are in a relation satisfying the following formula (3).

$$Y>3X/400+1 \quad (3)$$

According to the electrophotographic developer of the present invention, it becomes possible to certainly prevent blur of the image, such as forward flow or backward flow, while maintaining a high image density.

That is, the present inventors have studied to define a voltage dependence of the resistance value in the developer comprising the magnetic carrier and toner, not only magnetic carrier. That is, it has been considered that the amount of the toner to be adhered onto the surface of the photoconductor is determined by not only resistance value of the magnetic carrier, but also resistance value of the developer comprising the magnetic carrier and toner and, therefore, blur of the toner to the vicinity of the image part can be prevented by enhancing the edge effect while maintaining the high image density of the solid image part when the voltage dependence of the resistance value of the developer is increased.

Therefore, the present inventors have defined Y calculated from the above formula (1) by using the resistance value $R_{500}$ (Ω·cm) at the electric field of 500 V/cm and the resistance value $R_{2500}$ (Ω·cm) at the electric field of 2500 V/cm as the voltage-dependent index of the resistance value of the developer, and studied about the range of Y wherein blur of the image can be certainly prevented while maintaining the high image density. However, it became apparent that blur of the image can not be certainly prevented, sometimes, even if the value of Y is the same.

Therefore, the present inventors have studied about other parameters of the developer. As a result, it has been found that the distribution of the charged amount of the respective toner particles is another important factor of blur of the image.

That is, even if the voltage dependence of the resistance value of the developer satisfies the level enough to prevent blur of the image, sufficiently, the respective toner particles constituting the toner image are not firmly fixed onto the surface of the photoconductor by an electrostatic attraction force, when the charged amount of the respective toner particles varies widely. Particularly, when the proportion of the non-charged toner of which charged amount is not more than the predetermined value is large, the toner particles are liable to be scratched off by the magnetic blush. As a result, blur such as forward flow or backward flow is liable to be generated.

To the contrary, as the proportion of the non-charged toner is decreased, the respective toner particles are firmly fixed onto the surface of the photoconductor by an electrostatic attraction force. Therefore, the generation of blur due to scratching off of the magnetic brush, such as forward flow or backward flow can be prevented, more certainly.

Therefore, the present inventors have determined the range wherein blur of the image can be certainly prevented while maintaining the high image density, which is defined by both of a number proportion X (%) of the non-charged toner within a range defined by the formula (2) in the charged amount distribution of the toner defined by the charged amount Q (femt. C) and particle size D (μm) to the total toner, and the above-described voltage-dependent index Y of the developer.

Furthermore, according to the developer of the present invention, the proportion of the non-charged toner can be reduced and, therefore, it becomes possible to prevent contamination of the formed image or interior of the image forming apparatus by decreasing toner scattering. When the proportion of the non-charged toner becomes small, the apparent density of the developer becomes small and the fluidity thereof is improved. Therefore, it becomes possible to stir the developer easily and to prevent blocking of the developer.

DETAILED DESCRIPTION OF THE INVENTION

In the present invention, as described above, it is necessary that the voltage-dependent index Y of the developer and number proportion X (%) of the non-charged toner in the total toner satisfy the above formula (3). A straight line, which is indicated by a dashed line in FIG. 1, corresponds to the following formula (30).

$$Y=3X/400+1 \quad (30)$$

Figure 1:
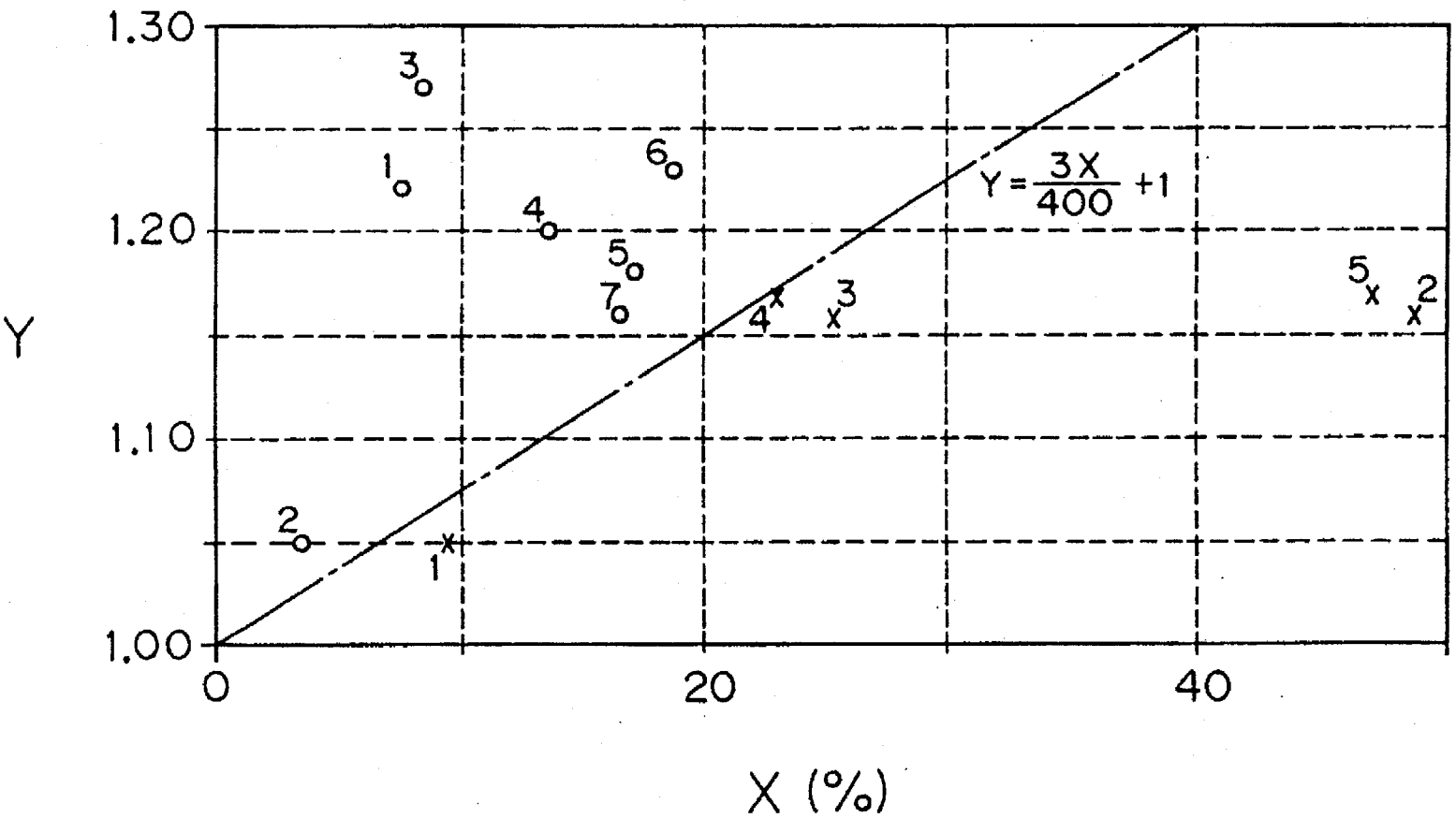
FIG. 1 is a graph illustrating a relation between the voltage-dependent index Y and number proportion X (%) of the non-charged toner to the total toner in the respective toners obtained in Examples and Comparative Examples.

In FIG. 1, the region above this straight line (30) corresponds to the range satisfying the above formula (3).

When the above index Y and number proportion X do not satisfy the formula (3), that is, in the region of the straight line (30) and below the straight line (30) in FIG. 1, the proportion of the non-charged toner is too large in comparison with the voltage dependence of the resistance value of the developer. Therefore, blur of the image, such as forward flow or backward flow, can not be certainly prevented.

Furthermore, the voltage-dependent index Y is preferably within a range of 1.00 to 1.30. The index Y indicates a relation between the applied voltage and resistance value, as described above. Regarding the magnetic carrier and toner, the higher the applied voltage, the lower the resistance value is, while the lower the applied voltage, the higher the resistance value is. Therefore, it is impossible that the voltage index Y is less than 1.00, that is, the higher the applied voltage, the higher the resistance value is, while the lower the applied voltage, the lower the resistance value is. When the index Y exceeds 1.30, there is a problem that so-called carrier flow is generated at the solid image area of the formed image because the voltage dependence is too strong. Furthermore, it is more preferred that the index Y is within a range of 1.15 to 1.25 because of such a producing reason that no scatter in characteristics of the respective carrier particles is observed.

Furthermore, it is preferred that the number proportion X (%) of the non-charged toner in the total toner is not more than 40%. When the number proportion exceeds 40%, the proportion of the non-charged toner is too large. Therefore, in order to satisfy the formula (3), the index Y exceeds the above range, thereby causing a problem that carrier flow is generated at the solid image area, as described above. Furthermore, it is more preferred that the number proportion X (%) is not more than 20% so as to prevent toner scattering.

The electrophotographic developer of the present invention is composed of at least two components, i.e. magnetic carrier and toner. If necessary, various surface treating agents such as hydrophobic silica (fluidizing agent) can also be added to the toner particles.

In order to adjust the voltage dependent index Y of the electrophotographic developer, there can be used various methods, such as method of adjusting the voltage dependence of a magnetic carrier or a toner, a method of adjusting a proportion of a magnetic carrier, a toner and a surface treating agent, method of changing the kind of a surface treating agent, etc.

Among them, as the method of adjusting the voltage dependence of the magnetic carrier, for example, there can be used a method of changing the composition or particle size of the magnetic carrier. When the magnetic carrier is produced by sintering the magnetic powder, the burning conditions such as temperature or time may be changed. In case of magnetic carrier which additionally has a resin coat layer, the composition and thickness or producing condition of the resin coat layer may be changed.

As the method of adjusting the voltage dependence of the toner, for example, there can be used a method of changing the composition of the toner.

On the other hand, in order to adjust the number proportion X (%) of the non-charged toner included in the total toner, there can be used the following methods:

① method of adjusting the composition of a coating resin of a carrier,

② method of adjusting the kind and amount of an electric charge controlling agent of a toner, ③ method of adjusting the dispersion state of a carbon black in a toner particle when using a conductive carbon black as a colorant, and ④ method of adjusting the combination and amount of a surface treating agent. These methods may be used in combination. Among them, it is preferred to employ methods of ① and/or ②.

As the magnetic carrier and toner, which constitute the electrophotographic developer of the present invention, there can be used those of various constructions, which have hitherto been known.

Examples of the magnetic carrier include particles of iron, oxidation treatment iron, reduced iron, magnetite, copper, silicon steel, ferrite, nickel, cobalt, etc.; particles of alloys of these materials and manganese, zinc, aluminum, etc.; particles of iron-nickel alloy, iron-cobalt alloy, etc.; particles wherein fine powders selected from the above various materials are dispersed in a binding resin; particles of ceramics such as titanium oxide, aluminum oxide, copper oxide, magnesium oxide, lead oxide, zirconium oxide, silicon carbide, magnesium titanate, barium titanate, lithium titanate, lead titanate, lead zirconate, lithium niobate, etc.; particles of high dielectric constant substances such as ammonium dihydrogen phosphate ($NH_4H_2PO_4$), potassium dihydrogen phosphate ($KH_2PO_4$), Rochelle salt, etc.

Among them, iron powders (e.g. iron oxide, reduced iron, etc.) or ferrite particles are particularly preferred. These particles allow to form an image having a good image quality, because a change in electric resistance due to an environmental change or a change with time is small and a head of a magnetic brush is soft. These particles are also cheap.

Examples of the ferrite particles include particles of zinc ferrite, nickel ferrite, copper ferrite, nickel-zinc ferrite, manganese-magnesium ferrite, copper-magnesium ferrite, manganese-zinc ferrite, manganese-copper-zinc ferrite, etc.

The particle size of the magnetic carrier to be formed is about 10 to 200 μm, preferably about 30 to 150 μm. Furthermore, the saturation magnetization of the magnetic carrier is not specifically limited, but is preferably about 35 to 70 emu/g.

Examples of the resin of the resin coat layer, which may be formed on the surface of the magnetic carrier, include (meth)acrylic resin (i.e. acrylic resin or methacrylic resin), styrene resin, styrene-(meth)acrylic resin, olefin resin (e.g. polyethylene, chlorinated polyethylene, polypropylene), polyester resin (e.g. polyethylene terephthalate, polycarbonate), unsaturated polyester resin, vinyl chloride resin, polyamide resin, polyurethane resin, epoxy resin, silicone resin, fluorocarbon resin polytetrafluoroethylene, polychlorotrifluoroethylene, polyvinylidene fluoride), phenol resin, xylene resin, diallyl phthalate resin, etc.

Among them, it is particularly preferred to use (meth) acrylic resin, styrane resin, styrene-(meth)acrylic resin, silicone resin or fluorocarbon resin in view of friction charging properties with toner, mechanical strength, etc. The above resins may be used alone or in combination thereof.

It is preferred to add a thermosetting resin such as melamine resin to (meth)acrylic resin, styrene resin or styrene-(meth)acrylic resin, as a crosslinking agent and a charging properties modifier. The amount of the thermosetting resin is preferably about 0.1 to 5% by weight, based on the amount of the (meth)acrylic resin, etc.

Furthermore, there can be optionally added a small amount of additives for adjusting the characteristics of the resin coat layer, such as silica, alumina, carbon black, fatty metal salt, etc., to the resin coat layer.

The film thickness of the resin coat layer is about 0.05 to 1 μm, preferably about 0.1 to 0.7 μm.

In order to form a resin coat layer on the surface of the magnetic carrier, the respective components constituting the resin coat layer are firstly dissolved or dispersed in a suitable solvent to prepare a coating material, and then the coating material is applied on the surface of the magnetic carrier. The solvent is removed by drying with heating to cure the resin.

As the applying method of the coating material, there can be used any method, such as ① method of mechanical mixing, which comprises uniformly mixing a magnetic carrier with a coating material with a mixer such as V-type blender, Nauta Mixer (tradename), ② method of spraying, which comprises spraying a coating material to a magnetic carrier, ③ method of dipping, which comprises dipping a magnetic carrier into a coating material, ④ so-called fluidized bed method, which comprises charging a magnetic carrier in a fluidized bed type coating apparatus, supplying air from the lower part of the coating apparatus to float the magnetic carrier, thereby putting into a fluidized state, and then spraying a coating material to the magnetic carrier of a floated and fluidized state, ⑤ tumbling bed method, which comprises bringing a magnetic carrier in a tumbling state into contact with a coating material, etc.

As the solvent for coating material, for example, there are aromatic hydrocarbons such as toluene, xylene; halogenated hydrocarbons such as trichloroethylene, perchloroethylene; ketones such as acetone, methyl ethyl ketone; cyclic ethers such as tetrahydrofuran; alcohols such as methanol, ethanol, isopropanol.

The toner constituting the electrophotographic developer, together with the magnetic carrier, is prepared by dispersing a colorant, an electric charge controlling agent and various additives in particles of a fixing resin, according to the same manner as that used in a conventional technique.

Examples of the fixing resin include styrene resin (monopolymet or copolymer obtained by using a styrene or a substituted styrene) such as polystyrene, chloropolystyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylate copolymer (e.g. styrene-methyl acrylate copolymer, styrene-ethyl acrylate capolymer, styrene-butyl acrylate copolymer, styrene-octyl acrylate copolymer, styrene-phenyl acrylate copolymer), styrene-methacrylate copolymer (e.g. styrene-methyl methacrylate copolymer, styrene-ethyl methacrylate copolymer, styrene-butyl methacrylate copolymer, styrene-phenyl methacrylate copolymer), styrene-α-chloromethyl acrylate copolymer, styrene-acrylonitrile-acrylate copolymer, polyvinyl chloride, low-molecular weight polyethylene, low-molecular weight polypropylene, ethylene-ethyl acrylate copolymer, polyvinyl butyral, ethylene-vinyl acetate copolymer, rosin-modified maleic resin, phenol resin, epoxy resin, polyester resin, ionomar resin, polyurethane resin, silicone resin, ketone resin, xylene resin, polyamide resin and the like. These may be used alone or in combination thereof.

As the colorant, there can be used various colorants, which have hitherto been known, according to tints of the toner.

Examples of the colorant include the followings.

Black color carbon black, nigrosine dye (C.I. No. 50415B), lamp black (C.I. No. 77266), oil black, azo oil black, etc.

Red color

Du Pont oil red (C.I. No. 26105), rose bengal (C.I. No. 45435), orient oil red #330 (C.I. No. 6050), etc.

Yellow color chrome yellow (C.I. No. 14090), quinoline yellow (C.I. No. 47005), etc.

Green color malachite green oxalate (C.I. No. 42000), etc.

Blue color chalco oil blue (C.I. No. azoec blue 3), aniline blue (C.I. No. 50405), methylene blue chloride (C.I. No. 5201), phthalocyanine blue (C.I. No. 74160), ultramarine blue (C.I. No. 77103), etc.

These can be used alone or in combination thereof. It is preferred that the colorant is used in an amount of 1 to parts by weight, based on 100 parts by weight of the fixing resin.

Among the above colorants, a carbon black is particularly preferred in case of black toner.

The electric charge controlling agent is blended to control the friction charging properties of the toner, and any one of electric charge controlling materials for controlling positive electric charge and negative electric charge may be used according to the charged polarity of the toner.

Among them, as the electric charge controlling agent for controlling positive electric charge, there are various electric charge controlling agents, which have hitherto been known, such as organic compounds containing a basic nitrogen atom, e.g. basic dye, aminopyrin, pyrimidine compound, polynuclear polyamino compound, aminosilanes.

On the other hand, as the electric charge controlling agent for controlling negative electric charge, there are oil-soluble dyes such as nigrosine base (CI5045), oil black (CI26150), Bontron S (trade-name), Spilon black (trade-name); electric charge controlling resins such as styrene-styrenesulfonic acid copolymer; compounds containing a carboxyl group, such as metal chelete alkyl salicylate; metal complex dye, fatty metal soap, fatty acid soap, metal naphthenate, etc.

The electric charge controlling agent is used in an amount of 0.1 to 10 parts by weight, preferably 0.5 to 8 parts by weight, based on 100 parts by weight of the fixing resin.

Furthermore, it is preferred that the proportion of the electric charge controlling agent which is present on the surface of the toner particle (i.e. surface dye density) is not less than 30% by weight, based on the total weight of the controlling agent to be added to the toner. This is because the above-described blur such as forward flow, backward flow is considerably generated when using the toner of which surface dye density is not less than 30% by weight, as described above, and the advantages of the present invention are remarkably exhibited, particularly in the toner of which surface dye density is not less than 30% by weight.

In the present invention, it is also possible to apply to a toner of which surface dye density is less than 30% by weight.

It is also possible to blend an anti-offset agent to the toner to impart an anti-offset effect in the toner, in addition to the above respective components.

Examples of the anti-offset agent include aliphatic hydrocarbons, aliphatic metal salts, higher fatty acids, fatty acid esters or partially saponified material thereof, silicone oil, various waxes. Among them, aliphatic hydrocarbons having a weight-average molecular weight of about 1000 to 10000 are particularly preferred. Examples thereof include low-molecular weight polypropylene, low-molecular weight polyethylene, paraffin wax, low-molecular weight olefin polymer comprising an olefin unit having carbon atoms of not less than 4, silicone oil, and they may be suitably used alone or in combination thereof.

The anti-offset agent is used in an amount of 0.1 to 10 parts by weight, preferably 0.5 to 8 parts by weight, based on 100 parts by weight of the fixing resin.

In addition, various additives such as stabilizer may be blended in the appropriate amount.

The toner can be produced by uniformly melting and kneading a mixture, which is obtained by uniformly premixing the above respective components with a dry-blender, a Henschel mixer, a ball mill, etc., with a kneading apparatus such as a Banbury mixer, roll, a single- or twin-screw extruder, cooling the resulting kneaded mixture, followed by pulverizing and optional classifying. It can also be produced by a suspension polymerization method.

It is preferred that the particle size of the toner is preferably 3 to 35 μm, particularly 5 to 25 μm. In case of small particle size toner for the purpose of enhancing the image quality of the image to be formed, the particle size is preferably about 4 to 10 μm.

As the surface treating agent to be added to the toner, there can be used various surface treating agent, which have hitherto been used, such as inorganic fine powder, fluorocarbon resin particle. Among them, silica surface treating agents containing hydrophobic or hydrophilic silica fine particles (e.g. ultrafine particulate silica anhydride, colloidal silica) are suitably used, particularly.

An amount of the surface treating agent to be added is not specifically limited and it may be the same as a conventional amount. For example, it is preferred to add the surface treating agent in an amount of about 0.1 to 3.0 parts by weight, based on 100 parts by weight of the toner particle. In some case, the amount of the surface treating agent may deviate from this range.

The toner density in the electrophotographic material of the present invention is the same as a conventional density, i.e. about 2 to 15% by weight.

The developer of the present invention can be used for an image forming apparatus utilizing the above-described forward or reverse direction type magnetic brush developing method. In case of forward direction type, forward flow can be effectively prevented. In case of reverse direction type, backward flow can be effectively prevented.

As described above, according to the electrophotographic developer of the present invention, it becomes possible to certainly prevent blur of the image, such as forward flow or backward flow, while maintaining the high image density.

EXAMPLES

The following Examples and Comparative Examples further illustrate the present invention in detail.

Example 1

Production of magnetic carrier

Iron oxide ($Fe_2O_3$), copper oxide (CuO) and zinc oxide (ZnO) were blended in the proportion (weight ratio) of 60:20:20 ($Fe_2O_3$:CuO:ZnO), and the mixture was subjected to burning at a temperature of 900° C., pulverized and then classified to prepare a carrier core material having an average particle size of 80 μm.

The surface of this carrier core material was coated with 0.3% by weight of a styrene-acrylic resin using a fluidized bed method to produce a magnetic carrier.

Production of toner

100 Parts by weight of a styrene-acrylic resin as the fixing resin, 8 parts by weight of carbon black (trade name of "Printex L", manufactured by Tegsa Co., Ltd.) as the colorant, 1.5 parts by weight of an electric charge controlling resin for controlling negative electric charge (Bontron S34, manufactured by Orient Kagaku Co., Ltd.) and 1.5 parts by weight of a polypropylene wax (trade name of "Biscoal 550P", manufactured by Sanyo Chemical Industries, Ltd.) as the release agent were mixed and, after melting and kneading at 150° C. for 10 minutes, the mixture was pulverized and classified to prepare a toner particle having an average particle size of 12 μm.

To 100 parts by weight of the toner particle obtained, 0.2 parts by weight of a hydrophobic silica (trade name of "R972", manufactured by Nihon Aerogyl Co., Ltd.) as the surface treating agent was added to prepare a toner.

Production of electrophotographic developer

The above magnetic carrier and toner were mixed in the weight ratio of 95.5:4.5 (magnetic carrier:toner) to produce an electrophotographic developer.

Example 2

According to the same manner as that described in Example 1 except for using a magnetic carrier obtained by blending iron oxide ($Fe_2O_3$), copper oxide (CuO), zinc oxide (ZnO), calcium oxide (CaO) and magnesium oxide (MgO) in the weight ratio of 63:14:14:1:1 ($Fe_2O_3$:CuO:ZnO:CaO:MgO), burning the mixture at a temperature of 900° C., followed by pulverizing and classifying to obtain a carrier core material having an average particle size of 80 μm, and then coating the surface of this carrier core material with 0.15% by weight of a styrene-acrylic resin using a fluidized bed method, an electrophotographic developer was produced.

Example 3

According to the same manner as that described in Example 1 except for using a magnetic carrier obtained by using a mixture of a styrene-acrylic resin and a melamine resin in the proportion (weight ratio) of 100:5 (styrene-acrylic resin:melamine resin) as the coating resin for coating on the surface of the carrier core material, an electrophotographic developer was produced.

Example 4

According to the same manner as that described in Example 2 except for changing the burning temperature of the carrier core material to 950° C., an electrophotographic developer was produced.

Example 5

According to the same manner as that described in Example 1 except for changing the average particle size of the carrier core material to 85 μm, an electrophotographic developer was produced.

Example 6

According to the same manner as that described in Example 1 except for changing the amount of the hydrophobic silica to be added as the surface treating agent to 0.1% by weight, an electrophotographic developer was produced.

Example 7

According to the same manner as that described in Example 1 except for changing the melting and kneading temperature upon producing of the toner particle to 950° C. to deteriorate the dispersion state of carbon black, an electrophotographic developer was produced.

Comparative Example 1

According to the same manner as that described in Example 2 except for using an acryic-modified silicone resin as the coating resin for coating on the surface of the carrier core material and changing the coating amount thereof to 0.5% by weight, an electrophotographic developer was produced.

Comparative Example 2

According to the same manner as that described in Example 1 except for using an acryic-modified silicone resin as the coating resin for coating on the surface of the carrier core material and changing the coating amount thereof to 0.5% by weight, an electrophotographic developer was produced.

Comparative Example 3

According to the same manner as that described in Comparative Example 2 except for changing the coating amount of the coating resin to 0.25% by weight, an electrophotographic developer was produced.

Comparative Example 4

According to the same manner as that described in Example 2 except for changing the burning temperature of the carrier core material to 850° C., an electrophotographic developer was produced.

Comparative Example 5

According to the same manner as that described in Example 1 except for changing the melting and kneading time upon producing of the toner particle to 5 minutes and changing the surface dye density from 32% to 40%, an electrophotographic developer was produced.

The electrophotographic developers obtained in the above Examples and Comparative Examples were subjected to the following tests.

Measurement of resistance value of developer and calculation of voltage-dependent index Y Regarding the respective electrophotographic developers of Examples and Comparative Examples, the resistance value $R_{500}$ (Ω·cm) at the electric field strength of 500 V/cm and resistance value $R_{2500}$ (Ω·cm) at the electric field strength of 2500 V/cm were measured by using the following method for measuring a resistance value. Then, the voltage-dependent index Y of the developer was calculated from the measured values according to the above formula (1).

Method for measuring resistance value

Figure 2:
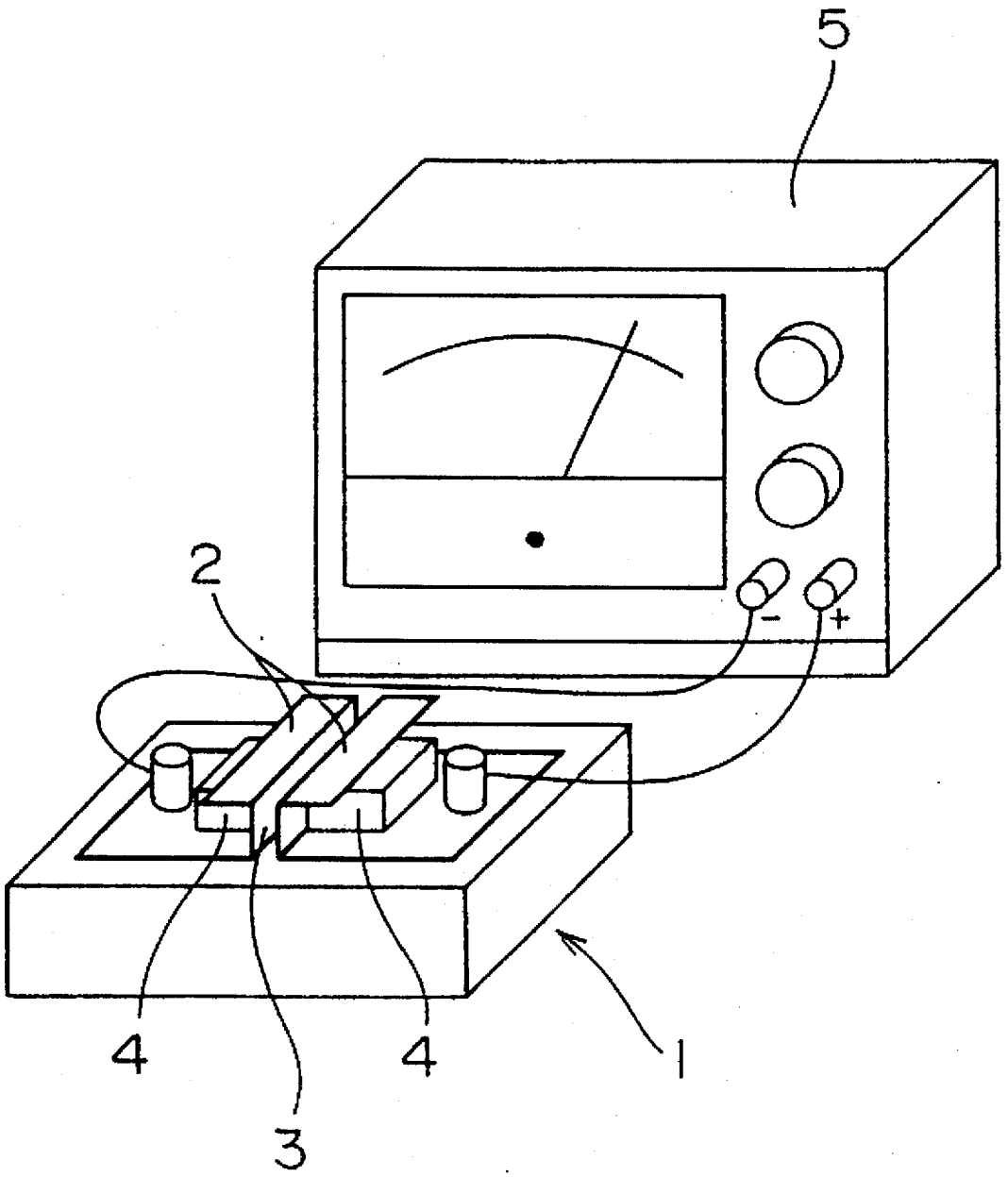
FIG. 2 is a schematic perspective diagram illustrating an apparatus for measuring a resistance value of the respective developers of Examples and Comparative Examples.

After weighing 200±5 mg of a developer, the developer was subjected to moisture conditioning by exposing in a working atmosphere (23±3° C., 60±5%RH) for 30 minutes or more, and then set in a gap 3 of a predetermined distance (2 mm) between a pair of electrodes 2, 2 of a bridge type electric resistance measuring apparatus 1 shown in FIG. 2.

The above bridge type electric resistance measuring apparatus 1 is used for measuring an electric resistance of a developer in the state wherein the developer is laid between both electrodes 2, 2, like a bridge, by a magnetic force between magnets 4, 4 provided behind a pair of electrodes 2, 2, respectively.

Then, an electric field of 500 V (electric field strength: 2500 V/cm) was applied to the developer between both electrodes 2, 2 using an ultra-insulation meter 5 connected with a pair of electrodes 2, 2. After 10 seconds, the resistance value $R_{2500}$ (Ω·cm) was determined by reading the value pointed by the ultra-insulation meter.

Then, 5 to 10 seconds have passed since the application of the electric field was stopped, an electric field of 100 V (electric field strength: 500 V/cm) was applied to the developer between both electrodes 2, 2 using the ultra-insulation meter 5. After 10 seconds, the resistance value $R_{500}$ (Ω·cm) was determined by reading the value indicated by the ultra-insulation meter.

Measurement of charged amount distribution of toner and calculation of number proportion of non-charged toner Regarding the respective toners used for the electrophotographic developers of Examples and Comparative Examples, a relation between the charged amount Q (femt. C) and particle size D (μm) was determined using the following method for measuring a charged amount.

Figure 4:
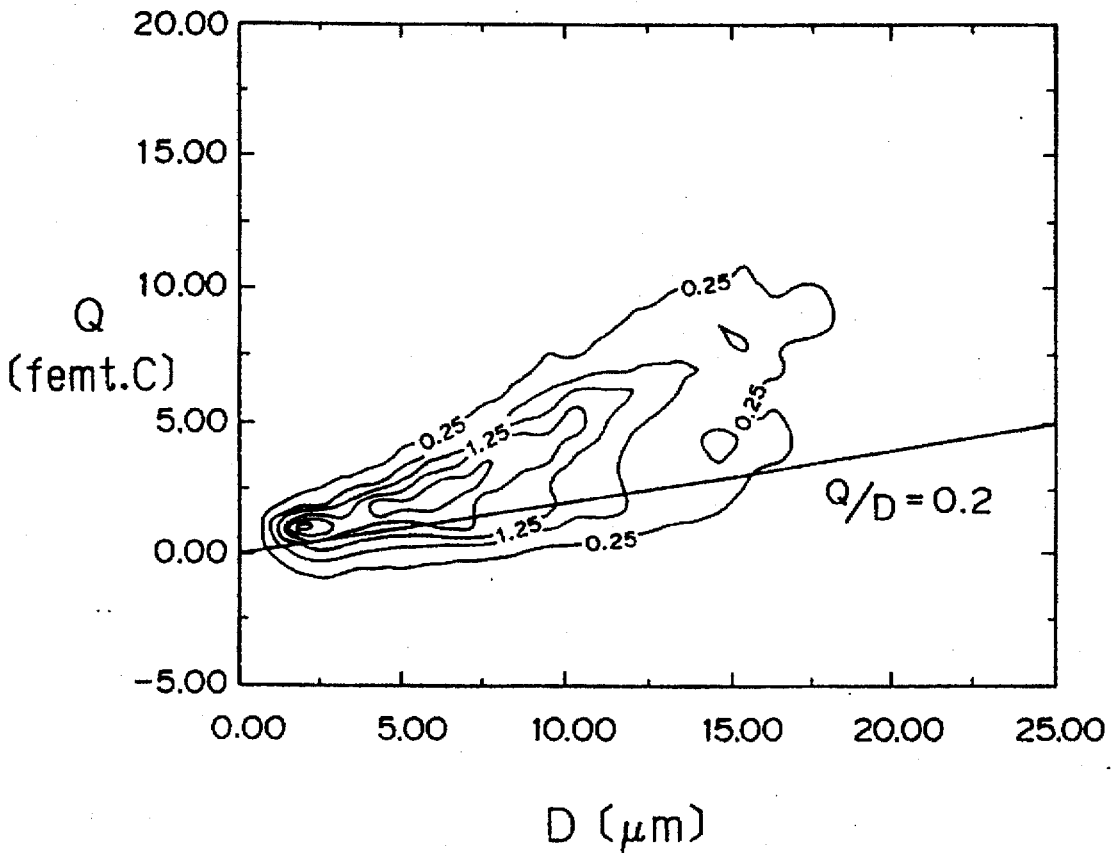
FIG. 4 is a graph illustrating one embodiment of a charged amount distribution of the toner, which is obtained by the charged amount of the toner measured with the apparatus of FIG. 3.

The number of toners having a predetermined charged amount Q (femt. C) and particle size D (μm) was totaled from the results and a proportion thereof to the total number of toners was calculated to determine a charged amount distribution of the toner, which is defined by the charged amount Q (femt. C) and particle size D (μm) of the toner, one embodiment of which is shown in FIG. 4. Thereby, the number proportion X (%) of the non-charged toner within a region of the formula (2) (within a region below the straight line represented by (Q/D=0.2 in FIG. 4) in this charged amount distribution to the total toner was calculated.

FIG. 4 is a graph illustrating a charged amount distribution of the positive charged toner by using a contour line. For example, a contour line on which a numeral 0.25 is described is obtained by connecting plots of toners of which number the proportion to the total toner is 0.25% among toners having a specific charged amount Q (femt. C) and particle size D (μm).

Method for measuring charged amount

Figure 3:
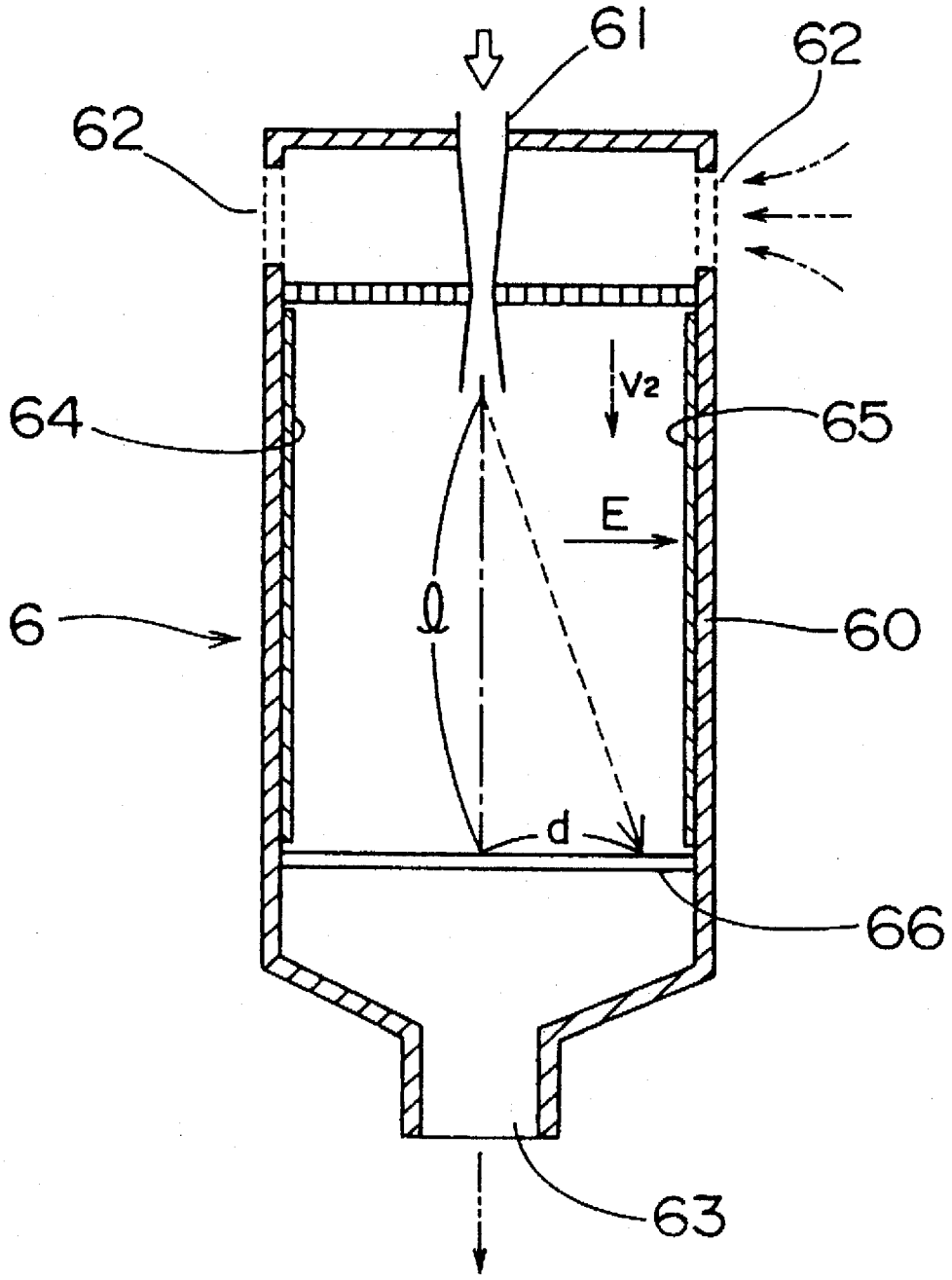
FIG. 3 is a schematic cross section illustrating an apparatus for measuring a charged amount of the toner in the electrophotographic developers of Examples and Comparative Examples.

A toner charged amount measuring apparatus 6 shown in FIG. 3 was used. In this apparatus, a nozzle 61 for dropping a toner and an air inlet 62 are provided at the upper and center part of a cylindrical body 60, and a pump (not shown) is connected with a lower air outlet 63. Furthermore, a pair of electrodes 64, 65 for applying an electric field are provided in the middle of the body 60, and a filter 66 for collecting the toner is set below the electrodes at the position at the distance 1 from the front end of the nozzle 61.

In the case of measuring, the pump was firstly operated and an electric field E indicated by the arrow of the solid line in FIG. 3 was applied between both electrodes 64, 65 while passing through an air flow at a constant velocity (velocity: $v_2$) from the air inlet 62 to the air outlet 63, as shown by the chain line in FIG. 3.

Then, the electrophotographic developer of the respective Examples and Comparative Examples is charged and the magnetic carrier is separated from the toner. The toner in the charged state immediately after separation was dropped from the nozzle 61 into the body 60 while counting the number of the toner to collect it with the filter 66.

Then, the filter 66 used for collecting a predetermined number (about 3000) of toners was subjected to an image analyzer to measure the particle size D (μm) and distance d of the respective toners. The charged amount Q (femt. C) and particle size D (μm) of the respective toners were determined from the results.

The toner dropped from the nozzle 61 into the body 60 drops in the direction, which is slightly shifted to the right direction from the center line indicted by the chain line in FIG. 3, according to the influence of the electric field E (indicated by the arrow of the broken line in FIG. 3), and the toner is collected at the position at the distance d from the center of the filter 66. In this case, the larger the charged amount Q (femt. C) and the smaller the particle size D (μm) (the mass is small), the larger the influence of the electric field upon the respective toners during dropping is. Therefore, the distance d from the center becomes large. Since the electric field E and velocity of the air flow $v_2$ are constant, as described above, the above distance d has a certain relation with the charged amount Q (femt. C) and particle size D (μm) of the toner. Accordingly, as described above, when the filter 66 used for collecting the predetermined number of toners is subjected to the image analyzer to determine the particle size D (μm) and distance d of the respective toners, the charged amount Q (femt. C) and particle size D (μm) of the respective toners can be determined.

Practical machine test

A black and white manuscript was copied, using the electrophotographic developer of the respective Examples and Comparative Examples for an electrostatic copying machine (DC-1415, manufactured by Mira Industrial Co., Ltd.) utilizing a forward direction type magnetic brush developing method, and the image density of the black solid part of the respective images was measured using a reflection densitometer (TC-6D, manufactured by Tokyo Denshoku Co., Ltd.). In addition, the forward flow within a region which is 2 mm ahead of the black solid part was visually observed to evaluate according to the following criterion of four levels.

◎: No forward flow is observed. ○: Slight forward flow is observed, but causing no problem on practical use.

X: Some forward flow is observed.

XX: Severe forward flow is observed, and is impossible to put to practical use.

The above results are shown in Table 1. In addition, a relation between the voltage-dependent index Y and number proportion X (%) of the non-charged toner in the total toner in the respective Examples and Comparative Examples is shown in FIG. 1. Incidentally, ○ and X indicate the results of the Example and Comparative Example, respectively. Furthermore, the numerals put closely to ○ and X indicate Example Nos. and Comparative Example Nos., respectively.

TABLE 1

| EXAMPLE NO. | $R_{500}$ (Ω · cm) | $R_{2500}$ (Ω · cm) | Y | X | FOR-WARD FLOW | IMAGE DEN-SITY |
|---|---|---|---|---|---|---|
| 1 | $2.5 \times 10^{11}$ | $2.4 \times 10^{9}$ | 1.22 | 7.5 | ○ | 1.40 |
| 2 | $1.4 \times 10^{10}$ | $4.6 \times 10^{9}$ | 1.05 | 3.5 | ○ | 1.45 |
| 3 | $1.0 \times 10^{13}$ | $1.6 \times 10^{10}$ | 1.27 | 8.3 | ◎ | 1.37 |
| 4 | $8.7 \times 10^{10}$ | $1.3 \times 10^{9}$ | 1.20 | 13.5 | ○ | 1.41 |
| 5 | $9.0 \times 10^{10}$ | $1.9 \times 10^{9}$ | 1.18 | 17.0 | ○ | 1.39 |
| 6 | $1.2 \times 10^{11}$ | $1.0 \times 10^{9}$ | 1.23 | 18.7 | ○ | 1.42 |
| 7 | $5.0 \times 10^{10}$ | $1.7 \times 10^{9}$ | 1.16 | 16.5 | ○ | 1.39 |
| COMP. EX. 1 | $1.7 \times 10^{9}$ | $6.5 \times 10^{8}$ | 1.05 | 9.6 | x | 1.44 |
| COMP. EX. 2 | $6.0 \times 10^{9}$ | $2.7 \times 10^{8}$ | 1.16 | 48.7 | xx | 1.45 |
| COMP. EX. 3 | $7.0 \times 10^{9}$ | $3.0 \times 10^{8}$ | 1.16 | 25.5 | x | 1.46 |
| COMP. EX. 4 | $6.3 \times 10^{10}$ | $1.8 \times 10^{9}$ | 1.17 | 23.0 | x | 1.44 |
| COMP. EX. 5 | $1.3 \times 10^{10}$ | $4.5 \times 10^{8}$ | 1.17 | 47.0 | x | 1.45 |

What is claimed is:

1. An electrophotographic developer comprising a magnetic carrier and a toner, wherein a voltage-dependent index Y of the developer, obtained from resistance values $R_{500}$ (Ω·cm) and $R_{2500}$ (Ω·cm), which are measured at electric field strengths of 500 V/cm and 2500 V/cm, respectively, in accordance with the formula (1):

$$Y=\log(R_{500})/\log(R_{2500}) \quad (1)$$

and a number proportion X (%), in the total toner, of a non-charged toner which is within a region of the formula (2):

$$Q/D<0.2 \quad (2)$$

in a charged amount distribution of toner defined by a charged amount Q (femt. C) and a particle size D(μm) of the toner, have a relation satisfying the following formula (3):

$$Y>3X/400+1 \quad (3).$$

2. The electrophotographic developer according to claim 1, wherein the voltage-dependent index Y is within a range of 1.00 to 1.30.

3. The electrophotographic developer according to claim 1, wherein the number proportion X (%) of the non-charged toner to the total toner is not more than 40%.

4. An electrophotographic developer according to claim 1, wherein the surface of the magnetic carrier is covered with a resin coating layer.

5. An electrophotographic developer according to claim 4, wherein the resin coating layer has a thickness in the range from 0.05 μm to 1 μm.

6. A developing method which comprises the steps of:

forming an electrostatic latent image on the surface of a photoconductor;

forming a toner image by contacting electrophotographic developer with the surface of the photoconductor to adhere toner contained in the developer to the electrostatic latent image, the electrophotographic developer including a magnetic carrier and a toner, wherein a voltage-dependent index Y of the developer, obtained from resistance values $R_{500}$ (Ω·cm) and $R_{2500}$ (Ω·cm), which are measured at electric field strengths of 500 V/cm and 2500 V/cm, respectively, in accordance with the formula (1):

$$Y=\log(R_{500})/\log(R_{2500}) \quad (1)$$

and a number proportion X (%), in the total toner, of a non-charged toner which is within a region of the formula (2):

$$Q/D<0.2 \quad (2)$$

in a charged amount distribution of toner defined by a charged amount Q (femt. C) and a particle size D(μm) of the toner, have a relation satisfying the following formula (3):

$$Y>3X/400+1 \quad (3); \text{ and}$$

transferring and fixing the toner image on a medium.

* * * * *